US006027612A

United States Patent [19]

Begemann et al.

[11] Patent Number: 6,027,612

[45] Date of Patent: Feb. 22, 2000

[54] WIRE SECTION AND METHOD OF DEWATERING A FIBER WEB IN A WIRE SECTION WEB

[75] Inventors: Ulrich Begemann, Heidenheim; Gerhard Kotitschke, Steinheim; Hans Dahl, Ravensburg; Volker Schmidt-Rohr; Karl Josef Böck, both of Heidenheim, all of Germany

[73] Assignee: Voith Sulze Papiermaschinen GmbH, Germany

[21] Appl. No.: 08/927,876

[22] Filed: Sep. 11, 1997

[30] Foreign Application Priority Data

Sep. 11, 1996 [DE] Germany ..... 196 36 792

[51] Int. Cl.[7] ..... D21F 1/00; D21F 11/00

[52] U.S. Cl. ..... 162/208; 162/203; 162/308; 162/334; 162/364; 162/301

[58] Field of Search ..... 162/115, 116, 162/334, 111, 208, 296, 297, 109, 289, 308, 353, 123, 364, 361, 203, 198, 252, 263, 259, 300, 301, 363

[56] References Cited

U.S. PATENT DOCUMENTS

| | | | |
|---|---|---|---|
| 483,340 | 9/1892 | Benham | 162/364 |
| 1,805,499 | 5/1931 | Schur | 162/334 |
| 2,369,653 | 2/1945 | Berry et al. | 162/364 X |
| 2,714,342 | 8/1955 | Beachler | 92/53 |
| 2,929,450 | 3/1960 | Kurz | 162/370 |
| 3,024,839 | 3/1962 | Beachler | 162/364 |
| 3,322,617 | 5/1967 | Osborne | 162/116 X |
| 3,549,742 | 12/1970 | Benz | 162/116 X |
| 3,775,244 | 11/1973 | Hubschmann | 162/116 X |
| 3,881,987 | 5/1975 | Benz | 162/116 |
| 5,552,021 | 9/1996 | Ilvespää et al. | 162/203 |
| 5,766,419 | 6/1998 | Linsuri et al. | 162/301 |

FOREIGN PATENT DOCUMENTS

| | | |
|---|---|---|
| 2106355 | 9/1993 | Canada . |
| 0050766 | 5/1982 | European Pat. Off. . |
| 0432571 | 6/1991 | European Pat. Off. . |
| 0629740 | 12/1994 | European Pat. Off. . |
| 233618 | 4/1911 | Germany . |
| 2053780 | 3/1972 | Germany . |
| 3123131 | 1/1986 | Germany . |
| 90/02840 | 3/1990 | WIPO . |

OTHER PUBLICATIONS

Holik, H., Blattbildung —Grundlage fur Papierqualitat. In: Wochenblatt fur Papierfabrikationen, Nov. 12, 1992, S. 443, 444, 446, 448, 450–453.

*Primary Examiner*—Jose Fortuna

*Attorney, Agent, or Firm*—Ostrolenk, Faber, Gerb & Soffen, LLP

[57] ABSTRACT

The invention concerns the wire section of a papermaking machine and a method of removing water from a fiber web in that section. A fiber suspension is discharged from a headbox on at least one and usually between two wires in the forming section. The fiber suspension is dewatered until it eventually reaches the point of immobility at which the fiber orientation is fixed. The rate of removal of water transverse to the direction of travel of the web is controlled at regions across the web. In particular, the rate of water removal is decreased at the edge regions of the wire and the web, as compared with the center region, to improve the transverse formation profile of the web. Various techniques for controlling the rate of water removal are disclosed including using different mesh of the wire at the edge regions and at the center region, a suction forming roll applying different levels of suction at different zones across the wire and the web, and adjustable ledges engaging one of the two wires and being adapted or adjusted to apply different pressure levels to the wire across the web.

18 Claims, 2 Drawing Sheets

WIRE SECTION AND METHOD OF DEWATERING A FIBER WEB IN A WIRE SECTION WEB

BACKGROUND OF THE INVENTION

The present invention relates to a method of draining a fiber web in a wire section of a paper machine, and to apparatus for draining the web in the wire section. Both the method and the apparatus are directed particularly to controlling the dewatering speed in the wire section. The apparatus is included in and the method is performed in a machine in which a fiber suspension is fed from a headbox onto at least one wire screen, called a wire, where the web is dewatered. The machine has at least one headbox, a forming region and a suction region. Upon formation of a web in a wire section of a paper machine, numerous influential factors must be observed to obtain a transverse profile of pulp consistency which is as uniform as possible, a uniform transverse profile of the transverse orientation of the fiber or transverse profile of formation, and in order to assure uniform quality of the surface of the paper.

In a traditional headbox, the width of the outlet slot or slice through which the jet of pulp emerges is controlled over the width of the web so as to establish as uniform a transverse profile of the consistency of the pulp as possible. However, obtaining a uniform transverse profile of the formation is uncertain.

Recently, there has been a considerable advance in controlling the headbox with regard to the consistency of the pulp by mixing a selected ratio of a second fiber suspension of lower concentration, for instance drained off water or white water, in a fiber suspension of higher concentration, while maintaining the total volume of flow constant, regardless of the volume of the stream being mixed in or of either stream. See U.S. application Ser. No. 08/662,980. This considerable improvement enables the transverse profile of the pulp consistency to be adjusted without detrimentally affecting the transverse profile of the fiber orientation. However, this arrangement still has the disadvantage that, despite the constant volume of flow of pulp over the width of the web, non-uniform web formation is obtained.

SUMMARY OF THE INVENTION

The object of the invention is to provide a wire section of a paper machine and a method of removing water from a fiber web in the wire section for producing a formation transverse profile which is as uniform as possible.

Furthermore, a dewatering device which extends over the width of the web, in particular a forming roll, is indicated as it is suitable for improving the web formation in the wire section.

In the invention, the rate of removal of water, i.e., the volume of water per unit of time that is removed from zones of the web transverse to the direction of travel of the web, is selectively adjusted at the zones in the edge regions of the fiber web, as compared with the zone at the center of the fiber web, before the immobility point of the suspension along the web path is reached to achieve the object of the invention. The immobility point is the point along the path of the fiber suspension traveling on the wire after which the web has been dewatered enough that the fibers in the fiber suspension no longer change their positions or orientations relative to each other.

The invention recognizes that after a web of paper is manufactured, it has a higher basis weight in the regions at the lateral side edges than it has in the region at its center because the web shrinks more in the region of the edges than in the center upon drying of the fiber web. The invention further recognizes that even for headboxes with controlled consistency of the pulp at the region of the edges of the web being formed, the smaller mass flow of solids at the edges reduces the resistance of the fiber mat to dewatering in the regions of the edges, as compared with the center of the web. The invention still further recognizes that the smaller heights or thicknesses of suspension in the edge regions of the fiber web before reaching the immobility point exert a detrimental influence on the transverse profile of the formation.

In the invention, the rate of water removal transverse to the direction of travel of the web changes in the edge regions or zones as compared with the center. The removal rate in the edge regions is preferably made slower, still before the point of immobility is reached. This produces a selected transverse profile of the pulp consistency before the formation transverse profile has been finally and firmly established. In this way, a uniform or at least a preselected transverse profile of the web being formed is fixed and it becomes substantially unchangeable after the immobility point has been reached.

The invention concerns the wire section of a papermaking machine and a method of removing water from a fiber web in that section. A fiber suspension is discharged from the headbox of the machine on at least one and usually between two wires in the forming section. The fiber suspension is dewatered until it eventually reaches the point of immobility at which the fiber orientation is fixed. The rate of removal of water transverse to the direction of travel of the web is controlled at various axial regions across the web. In particular, the rate of water removal is decreased at the lateral edge regions of the wire and the web, as compared with the center region of the web, to improve the transverse formation profile of the web. Various techniques for controlling the rate of water removal are disclosed including using different mesh of the wire along the edge regions and at the center region, a suction forming roll applying different levels of suction at different zones along the roll, which extends across the wire and the web, adjustable ledges pressing on the wire or on at least one of the two wires and being adapted or adjusted to apply different pressure levels to the contacted wire across the web.

In one technique, the fiber web is acted on by vacuum differently in the regions at the edges of the web than in the center region. In particular, stronger vacuum is applied preferably in the regions at the edges than in the center region. This represents a simple possibility for adapting the dewatering of the fiber web in the regions at its edges. As a result, the transverse profile of the pulp consistency may be made uniform before the immobility point is reached.

In a wire section according to the invention, means in the formation region change the dewatering rate in the regions at the lateral edges of the web as compared with the dewatering rate in the center region of the web. As explained above, this provides uniformity of the transverse profile of the consistency of the pulp before the immobility point is reached where the formation is fixed.

It is obvious that the invention can be used advantageously regardless of the nature of the headbox used and of the former used, which may for instance be a hybrid former, two wire former or a DUOFORMER®.

In an advantageous further development of the invention, at least one wire in the forming section has a different, and preferably a higher, resistance to web dewatering in the regions at the lateral edges of the wire and the web than at their centers. This is one possibility for controlling the speed of the removal of water from the fiber web at the edge regions as compared with the center region. In a simple manner, the wire may have a different size mesh in the region of the edges than in the center, preferably a smaller size mesh at the edges.

In another development, the forming section has a D-part contained in the formation region at which a series of formation ledges are arranged at intervals along the wire and extend transverse to the direction of travel of the web. The ledges are adjustable against the wire or against one of two wires in a two wire section, with at least some of the formation ledges being pressed less strongly in the regions of the edges of the wires than in the center of the wire or the ledges having a geometry which varies over the width of the web. Ledges which are capable of being adapted according to the invention are shown in U.S. Pat. No. 5,389,206, incorporated herein by reference. This also provides, a uniform transverse formation profile in the D-part, in which the fiber web reaches its point of immobility. In a further development, at least some of the formation ledges are developed so as to be of the adjustable sag type.

In yet another embodiment of the invention, at least some formation ledges extend over a central region of the web transverse to the direction of travel of the web.

The foregoing measures increase the speed of water removal in the center region of the fiber web as compared with the edge regions.

The object of the invention may be achieved by using a suction device, in particular a forming roll for a wire section, which exerts variable suction over the width of the wire and the web. This makes it is possible to control the rate of water removal over the width of the web to obtain a uniform transverse profile of web formation.

The water removal device can be a stationary or rotating element, for instance, a suction roll with a shell that rotates over a suction box. A water removal element that is developed as a suction roll, in particular as a forming roll, is divided into at least two lateral zones and one central zone, which are acted upon by respective selected vacuum levels and particularly may be acted on by different vacuum levels. This enables establishing a different vacuum level in the lateral edge zones than in the central zone. The rate of removal of water, i.e., volume per unit time, from the fiber web in the edge regions can be influenced, in particular it may be made slower than the rate of removal in the center region.

As an additional development, the axial width of any of the zones may be made variable by the machine operator. This enables better adaptation of the water removal speed transverse to the direction of travel of the web. The zones can be separated from each other by partitions which are displaceable in the axial direction. This provides a particularly simple way of obtaining adjustability of the widths of the zones.

As a further development, different circumferential angles over which suction is applied are provided in the individual zones along the suction roll. This also enables the speed of removal of water in the edge regions to be changed as compared with the speed of removal of water in the center region. Smaller suction angles are provided in the edge regions than in the center region enabling a greater rate of removal of water in the center region.

As yet another development, the vacuum level is adjustable, at least in the edge regions. This permits optimal adaptation of the water removal speed over the width of the paper web.

The above indicated features and others can be used not only in the combination indicated in each case but also in other combinations. Other objects, features and advantages of the invention will be evident from the following description of preferred embodiments, given with reference to the drawings.

DESCRIPTION OF A PREFERRED EMBODIMENT

Figure 1:
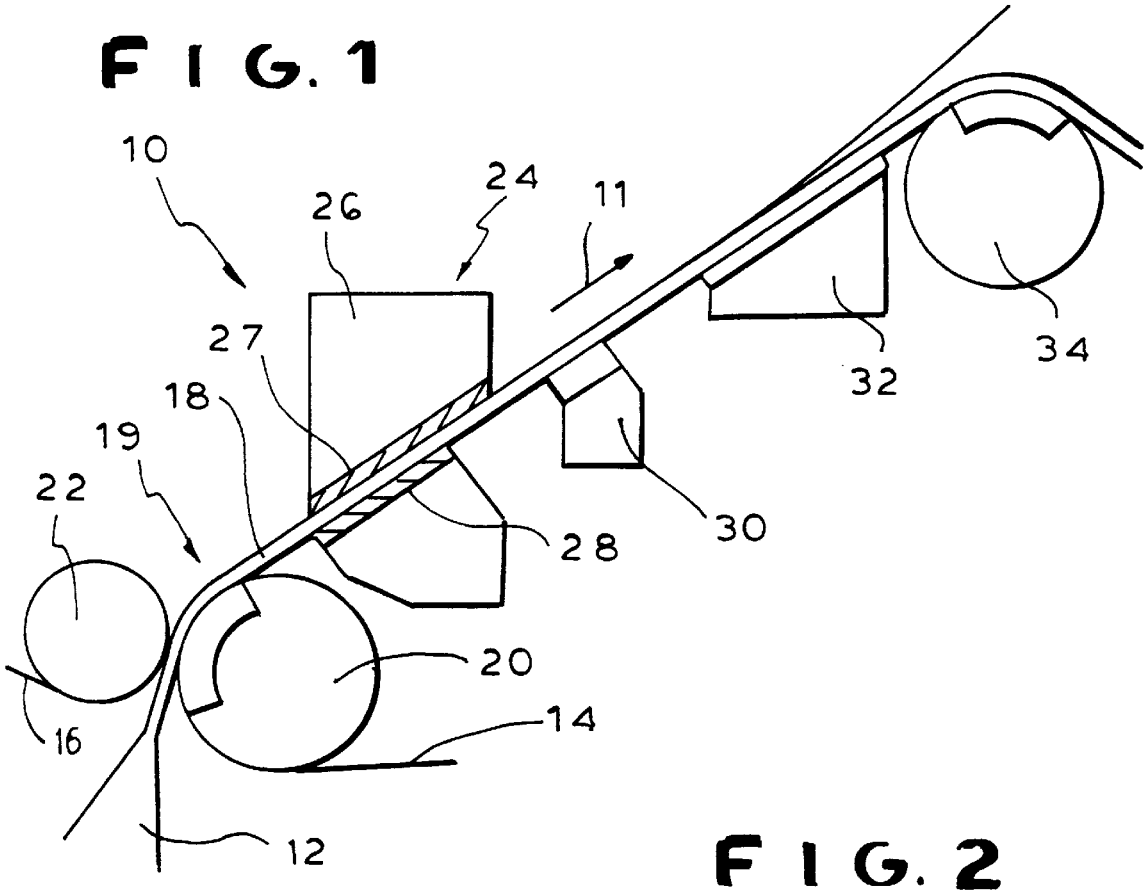
FIG. 1 diagrammatically shows a paper machine wire section in accordance with the invention.

FIG. 1 shows the entire wire section 10. The wire section 10 comprises a so-called DUOFORMER CFD, such as described in the "Wochenblatt für Papierfabrikation" 119 (11/12):455–460, 1992 and in U.S. Pat. No. 5,389,206.

Fiber suspension to be dewatered is introduced obliquely upward from a headbox between an upper paper machine forming section wire screen or wire 16 and a lower paper machine forming section wire screen or wire 14. The wires 14 and 16 are supported between a bottom forming roll 20 at wire 14 and a wire guide roll 22 or breast roll arranged obliquely above wire 16 on the side. Due to the curved path around the forming roll 20, water from the jet of pulp emerges obliquely upward through the upper wire 16 and is led away over a jet channel (not shown). After the wire has passed by the jet channel, the remaining water that passes through the upper wire 16 is led away, together with the front edge dewatering, on a vacuum skimmer (also not shown).

The forming region 19 is formed by the forming roll 20 and the first section of the wire path adjoining the roll 20. A so-called D-part 24 follows the region 19. There the fiber web is dewatered by forming elements which generate pulsations in the fiber suspension moving through the D-part. These forming elements are in the form of forming ledges 27, 28 which are present on at least one side and preferably on both sides of the wires 14, 16, as disclosed in U.S. Pat. No. 5,389,206, incorporated by reference.

The web being formed reaches a so-called immobility point within the D-part, which is the point at which the fibers in the fiber suspension between the wires 14, 16 become finally fixed in their orientation.

A suction region adjoins and follows the D-part. It comprises a wet suction box 30 followed by a combination suction box 32 which comprises a suction separation device for separating the upper wire 16 and two flat suction zones below. Then the separated lower wire 14 is conducted over a wire guide roll 34 which is developed as a suction roll.

In traditional manner, there is a uniform dewatering of the fiber web transverse to the direction of travel 11 of the web through the wires in the wire section.

The invention provides several measures to control the dewatering of the fiber web 18 in its lateral edge regions, as compared with its center region, preferably to slow drying at the edges. The reason for doing this is explained with reference to FIG. 2. Even with a headbox 12 with controlled pulp consistency e.g., as in U.S. application Ser. No. 08/662,980, the fiber web 18 normally dries faster in the regions of the edges because a smaller mass flow of solids is introduced into the fiber web 18 in these regions, which reduces resistance to removal of water from the fiber mat or the web at its edge regions, as compared with the center region of the web.

Figure 2:
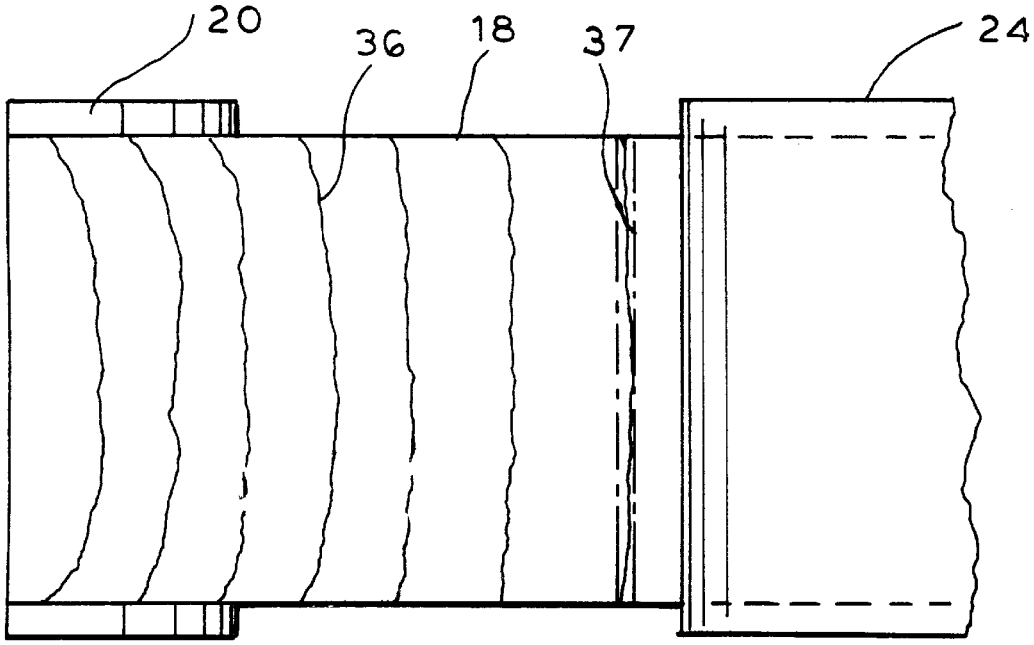
FIG. 2 is a top view of the fiber web in the formation region, with lines of equal pulp consistency being shown schematically.

Each line 36 in FIG. 2, characterizes, at a given time, points of the same pulp consistency on the fiber web 18. These lines could, therefore, also be referred to as so-called iso-consistency lines. The pulp consistency increases from left to right in FIG. 2, since water is being removed from the fiber web 18 on its path to the D-part 24. The iso-consistency lines 36 show that the fiber web 18 normally dries faster at its edges than in its center, as explained above. This correspondingly increases the consistency of the pulp at the edges. The measures according to the invention reduce the speed of the removal of water at the edges of the web to achieve a uniform transverse profile for the pulp consistency before the point of immobility of the fiber web 18 within the D-part 24.

In the ideal case, the iso-consistency lines 36 would extend precisely transverse to the direction of travel 11 of the web before the immobility point. An iso-consistency line 36, which is obtainable in practice, has only slight deviations from straight transverse, as shown between the two dash-dot lines 37. Reducing the speed of water removal from the fiber web 18 at its edges produces substantial uniformity in the forming profile, as compared with the prior art.

In principle, however, individual cases or special types of paper are also conceivable in which an increase in the speed of removal of the water in the edge regions is desired and the invention is useful for that as well.

There are several possible measures for controlling the speed of removal of the water over the width of the web:

Wires 14, 16 having a greater resistance to water removal in the edge regions than in the center can be used, for instance, porous wires having a mesh of smaller size at the edge regions than in the center region. Another possibility comprises forming the D-part formation ledges or foils 27, 28 to be pushed out more weakly at the edge regions of the wire than in the center region or to develop the ledges with adjustable sag across the wires as lighter pressure reduces the strength of pulsations in the suspension and reduces the extent of dewatering in the area of the pressures.

Yet another possibility comprises additionally providing formation ledges in certain places which extend only over a center region and not up into the regions of the edges of the web. All of the foregoing and other measures disclosed herein can be used individually or in any combination to control the rate of removal of water from the fiber web 18 at its edges.

Figure 3:
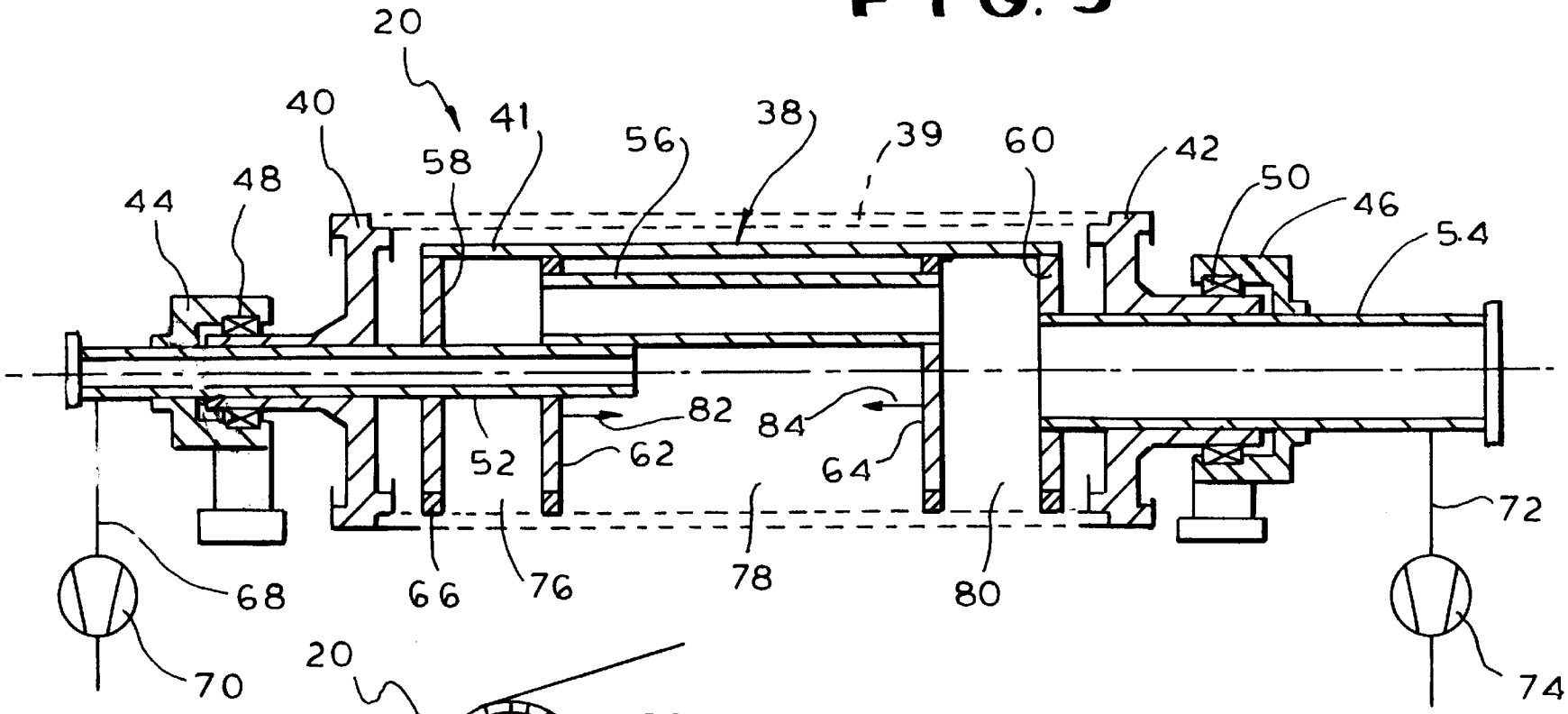
FIG. 3 is a longitudinal section through a suction roll according to the invention.

A preferred embodiment for decreasing the rate of removal of water from the fiber web 18 at its edge regions comprises using a forming roll 20, shown in FIG. 3, which is divided into at least two lateral edge zones 76, 80 and a center zone 78. Each zone can be acted on by a respective selected and perhaps different level of suction or vacuum. The special development of the forming roll 20 enables the rate of removal of water from the fiber web 18 only in the region of the roll 20 to be affected, while the rate of removal of the water after leaving the D-part 24 can be substantially constant, as seen over the width of the web.

The forming roll 20 is comprised of a rotatable perforated roll shell 39 having two roll end covers 40, 42, which are supported by respective tubular extensions in respective antifriction bearing 48, 50 in the stationary bearing housings 44, 46. Those housings support a stationary suction box 38 disposed inside the shell 39. The suction box 38 comprises tubular packing support body 41 closed by end disks 58, 60, and support tubes 52, 54 which rest in the bearing housings 44, 46 and serve as suction lines at both roll ends.

The suction box 38 is divided lengthwise or axially into the three suction zones 76, 78, 80. The two lateral edge zones 76, 80 are separated from the central zone 78 by two spaced apart partitions 62, 64. The two edge zones 76, 80 are connected to each other by a connecting tube 56, so that both zones can be suctioned from the right side via the support tube 54. Suction is produced in the tube 54 via a suction line 72 connected with blower 74. Suction is applied to the central zone 78 from the left side support tube 57, via a suction line 68, in which a respective, usually different, level of vacuum is produced by a connected blower 70.

Figure 4:
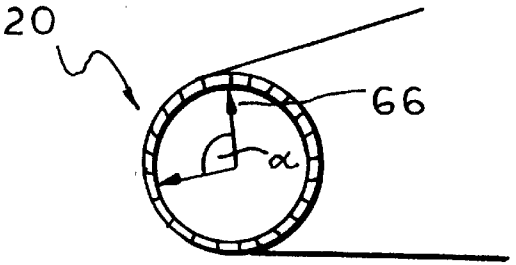
FIG. 4 is a diagrammatic cross section through the suction roll of FIG. 3 in a simplified showing on a reduced scale, for explaining the suction angle.

The suction zones 76, 78, 80 are sealed-off from the rotatable perforated shell 39 by sealing strips 66, which extend in both the axial and the circumferential directions, as in FIG. 4. The circumferential seals in FIG. 4 are positioned so that suction is applied only over a limited circumferential region of angle $\alpha$.

The two partitions 62, 64 are displaceable in the direction of the arrows 82, 84 toward and away from the center, enabling the size of each edge zone 76, 80 to be changed with respect to the adjacent center zone 78.

In addition, the suction angle $\alpha$, i.e. the angle around the center point, over which the suction zones extend, can also be made smaller in the edge zones 76, 80 than in the center zone 78 so as to permit less removal of water in the edge regions than in the center.

The forming roll 20 can also be divided into a larger number of suction zones to permit a better fine S adjustment of the rates of removal of the water along the axial direction. Furthermore, one or more of the blowers 70, 74 can be made adjustable for optimally adapting the vacuum applied to the corresponding suction zones to specific requirements.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of removing water from a fiber suspension and for controlling a transverse profile of the fibers in the suspension in a forming section of a paper machine, the fibers within the suspension being capable of changing their orientations until the suspension is dewatered to a point of immobility when the orientation of the fibers do not change, the method comprising the steps of:

supplying the fiber suspension onto at least one wire of the forming section of the paper machine;

exposing the fiber suspension of the web to: (i) a level of suction at its center; and (ii) respective levels of suction at its lateral edges in a manner for dewatering the fiber suspension through the wire; and controlling the rate of removal of water from the fiber suspension at edges of the web as compared with a center region of the web prior to the point of immobility of the fibers in the suspension by providing a different level of suction at the edge regions than at the center region of the web.

2. The method of claim 1, wherein controlling the rate of removal of water from the web comprises removing water from the web at a greater rate at the center region of the web than at the lateral edge regions.

3. The method of claim 1, wherein controlling the rate of removal of water comprises applying suction to the fiber suspension on the wire and controlling the levels of suction applied at zones across the wire and the web.

4. The method of claim 3, wherein the rate of water removal is controlled by applying lower levels of suction at zones at the edges of the web than at zones at the center of the web across the web on the wire.

5. The method of claim 1, wherein the forming section includes two wires traveling one above the other and the suspension is supplied between the two wires of the forming section and travels through the forming section between the two wires.

6. The method of claim 1, further comprising spraying the suspension onto the wire through the outlet of a headbox.

7. A method of removing water from a fiber suspension and for controlling a transverse profile of the fiber in the suspension in a forming section of a paper machine, the fibers within the suspension being capable of changing their orientations until the suspension is dewatered to a point of immobility when the orientation fibers do not change, the method comprising supplying the fiber suspension between at least two wires in the forming section of the paper machine, the wires having different resistances to the passage of water therethrough in edge regions of the wires than at a center region of the wires to control the rate of removal of water from the fiber suspension at edges of the web as compared with a center region of the web prior to the point of immobility of the fibers in the suspension.

8. A forming section of a paper making machine receiving a fiber suspension from a headbox, the fibers within the suspension being capable of changing their orientations until the suspension is dewatered to a point of immobility when the orientation of the fibers do not change, the forming section comprising:

at least one wire operable to receive the fiber suspension from the headbox, the wire having different resistances to the passage of water therethrough in edge regions of the wire than at a center region of the wire such that the rate of removal of water from the fiber suspension is controlled at edges of the web as compared with a center region of the web prior to the point of immobility of the fibers in the suspension.

9. The wire section of claim 8, wherein the wire comprises a porous mesh and the wire has a respective different size mesh in the edge regions thereof and in the center region thereof across the wire for achieving different resistances to removal of water through the wire mesh.

10. A forming section of a paper making machine for receiving a fiber suspension to be dewatered, the fibers within the suspension being capable of changing their orientations until the suspension is dewatered to a point of immobility when the orientation of the fibers do not change, the forming section including:

at least one forming section wire which receives the fiber suspension dispensed from the headbox, moves the wire through the forming section, and permits dewatering of the fiber suspension through the wire as the wire moves;

a suction apparatus which controls a rate of removal of water from the side edge regions of the fiber suspension of the web as compared with a rate of removal of water from the center region of the fiber suspension of the web across the wire such that respective selectable levels of suction at different zones across the wire are obtained prior to the point of immobility.

11. The forming section of claim 10, wherein the suction apparatus comprises a forming roll about which the wire is partially wrapped, the forming roll including means therein for selectively applying respective levels of suction at different regions across the wire and along the axis of the forming roll.

12. The forming section of claim 11, wherein the suction roll is divided into at least two lateral edge zones toward the edge regions of the wire and a central zone between the edge zones, and at each of the zones of the suction roll, the suction roll is selectively operable for applying respective levels of suction.

13. The forming section of claim 12, wherein the lateral widths of the zones of the forming roll are variable across the wire.

14. The forming section of claim 12, further comprising partitions in the suction roll for separating adjacent zones within the suction roll, and the partitions being displaceable in the axial direction along the suction roll for altering the axial length of each of the zones.

15. The forming section of claim 12, further comprising means for applying selective different levels of suction to the respective zones of the suction roll.

16. The forming section of claim 15, further comprising partitions in the suction roll for selectively varying the circumferential length around the suction roll over which suction can be applied of each zone along the roll, each suction zone having a respective circumferential length around the forming roll.

17. The forming section of claim 15, wherein the vacuum levels in at least the lateral edge zones of the forming roll are adjustable.

18. The forming section of claim 15, wherein the forming roll has a roll shell which is porous and the zones within the forming roll communicate through the porous shell of the forming roll, the porous shell being formed to have different resistances to flow of water through the roll shell over the axial length of the roll for selectively controlling the rate of removal of water from the web on the wire passing over the roll shell.

* * * * *